US005430535A

United States Patent [19]

Acquaviva

[11] Patent Number: 5,430,535

[45] Date of Patent: Jul. 4, 1995

[54] BIMODAL SHEET TRANSPORT SYSTEM FOR A COPIER

[75] Inventor: Thomas Acquaviva, Penfield, N.Y.

[73] Assignee: Xerox Corporation, Stamford, Conn.

[21] Appl. No.: 233,574

[22] Filed: Apr. 26, 1994

[51] Int. Cl.[6] ..... G03G 21/00

[52] U.S. Cl. ..... 355/309; 271/9.06; 355/321

[58] Field of Search ..... 355/308, 309, 311, 321, 355/325; 271/9

[56] References Cited

U.S. PATENT DOCUMENTS 4,881,729 11/1989 Culligan et al. ..... 271/9 X
5,053,818 10/1991 Smith ..... 355/311 X
5,192,071 3/1993 Kodama ..... 355/309 X

*Primary Examiner*—William J. Royer
*Attorney, Agent, or Firm*—Lloyd F. Bean, II

[57] ABSTRACT

An apparatus for copying printed irregular sheets such as tab sheets, transparencies or sheets with holes (i.e., hole for 3 ring binder) on a copier equipped with a Recirculating Document Handler (RDH) so that unwanted images of the platen transport on the copies do not appear. The apparatus includes an alternate semiautomatic document handling side loading slot on a copying station of a copier. Feeders are provided for feeding an irregular sheet from the semiautomatic document handling side loading slot to the copy station and a blank sheet from the recirculating document handler to the copy station. A tacking system is provided for tacking the blank sheet to the irregular sheet before the irregular sheet reaches the copy station to be copied.

19 Claims, 5 Drawing Sheets

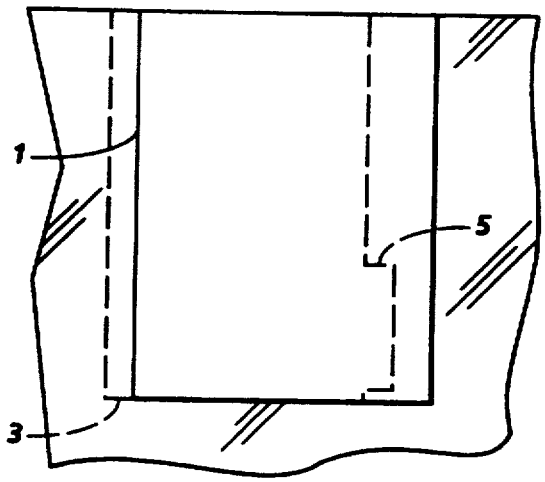
FIG. 7
FIG. 8
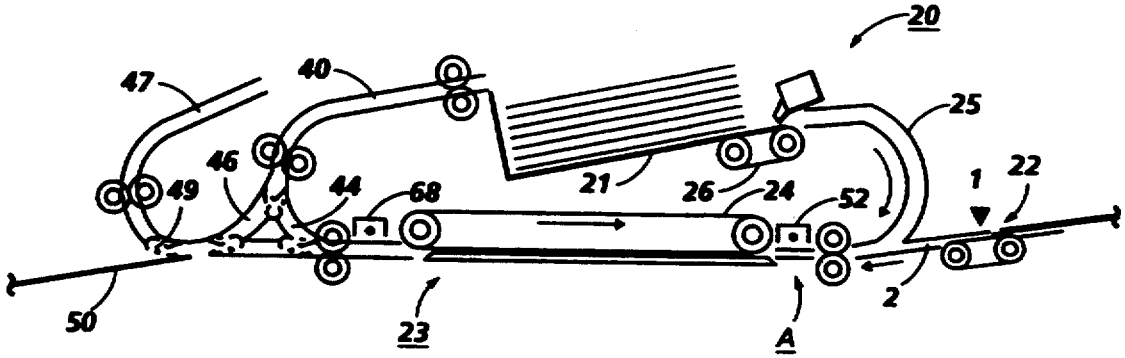

BIMODAL SHEET TRANSPORT SYSTEM FOR A COPIER

The present invention relates to a convenient automatic system for copying irregular sheets which are fed through a document handler of a xerographic or other photocopier, and printed by the copier.

When copying printed transparencies on a copier equipped with Recirculating Document Handler (RDH) unwanted images on the copies frequently appear due to belt show through caused by dirty belts or platen transport grooves during imaging of the transparency on the platen. These unwanted images also occur when copying other irregular sheets such as tab sheets, thin sheets or sheets with holes (i.e., from 3 ring binder) One method to remove show through from copies is through a manual procedure in which an operator lifts the RDH; places the irregular sheet on the platen, places a blank sheet thereover, and copies the irregular sheet. This manual method has been found satisfactory but has proved to be time consuming.

The present system enables simplified irregular sheet handling by an unskilled operator, automatically. It allows irregular sheets to be conventionally loaded into and utilized by the copier, without special operator manual handling. The present system allows and encourages casual operator printing of copy sets with irregular sheets by eliminating the difficulty and complexity of requiring the operator to make special manual page order placements, orientations, etc.

Related prior art, when creating transparencies it has been well known to employ transparencies with removable adhesive paper backing either on the feeding edge or over the entire back of the transparency. The transparency having removable adhesive paper backing over the entire back of the transparency provides protective separation between transparencies in the input and output trays. Generally, while feeding a transparency to be printed the removable adhesive paper backing provides improved feeding by reducing static attraction between transparencies thereby reducing multiple feeding of transparencies. The paper backing also provides an improved a frictional surface for the feeding rollers to feed the transparencies through the transfer and fusing stations of the copier. After the transparency is printed the removable adhesive paper backing generally is removed from the printed transparency. If an operator uses a transparency without removable adhesive paper backing, it is desirable to interleave duplicate or blanks sheets between each transparency in the output tray to provide protective separation between transparencies, such a method is disclosed in Xerox Disclosure Journal, Vol.6 No. 6 November/December 1984 entitled, "TRANSPARENCY/MASTER FEATURE" by Thomas Acquaviva.

Other methods far improving feeding of transparency through the transfer and fusing stations of the copier are also well known, for example U.S. Pat. Nos. 3,832,053 and 3,981,498 both disclose methods electrostatically tacking a transparency to a transport bet to feed the transparency through the transfer stations of the copier.

The present invention overcomes various of the above-discussed and other problems, and provides various of the above-noted and other features and advantages.

Pursuant to one aspect of the present invention, there is provided an apparatus for copying printed irregular sheets such as tab sheets, transparencies or sheets with holes (i.e., hole for 3 ring binder) on a copier equipped with a Recirculating Document Handler (REH) so that unwanted images of the platen transport on the copies do not appear. The apparatus includes an Alternate Semiautomatic Document Handling (SADH) side loading slot on a copying station of a copier. Means are provided for feeding an irregular sheet from the semiautomatic document handling side loading slot to the copy station and a blank sheet from the recirculating document handler to the copy station. A tacking system is provided for tacking the blank sheet to the irregular sheet before the irregular sheet reaches the copy station to be copied.

Another aspect of the invention there id provided a method for advancing sheets to a copying station of a copier, comprising the steps of feeding an irregular sheet and a blank sheet to the copy station. The step of tacking the blank sheet to the irregular sheet before the irregular sheet reaches the copy station. And, the step of copying the irregular sheet with the blank sheet tacked thereon at the copy station.

Yet another specific feature of the invention there is provided a printing machine with means for feeding and registering a sheet to an imaging station, which includes a tacking station for tacking a blank sheet to an irregular sheet before the irregular sheet is fed to the imaging station.

Other aspects of the present invention will become apparent as the following description proceeds and upon reference to the drawings in which:

FIG. 6 and 7 illustrates a tab sheet at the copying position with blank sheet thereon;

FIGS. 8 illustrates the feeding of both the irregular sheet and the blank sheet from the SADH slot;

Figure 10:
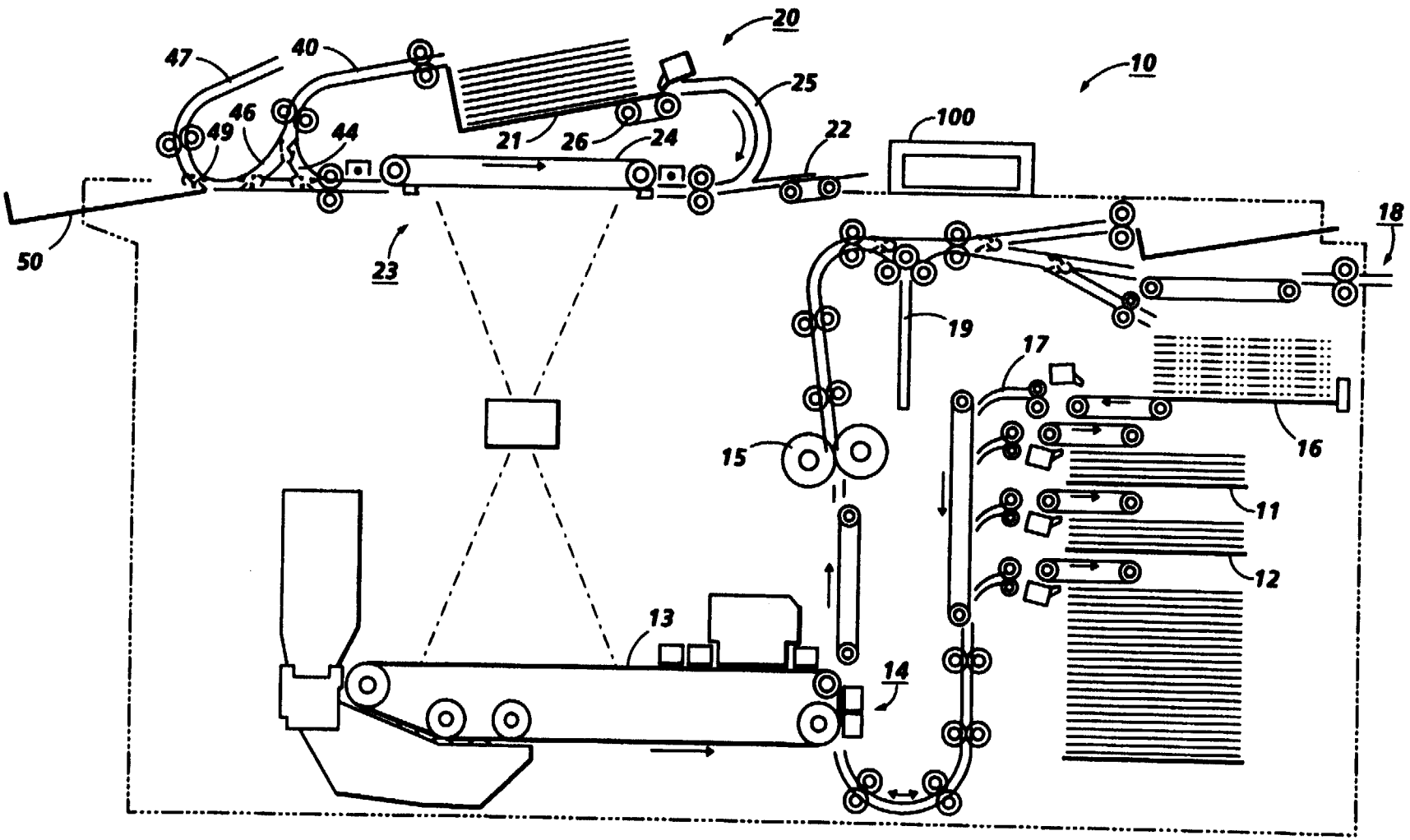
FIG. 10 is a schematic elevational view of an exemplary copier, with an exemplary RDH.

Turning to FIG. 10, there is shown an exemplary copier 10, with an exemplary recirculating document handler (RDH) 20, in various stages or steps of an exemplary operation providing one example of the bimodal sheet transport system. Both the copier 10 and RDH 20 are of a generally known type further described in art cited herein.

The exemplary copier 10 may be, for example, the well known Xerox Corporation "1075" or "1090" copiers, as illustrated and described in various patents cited above and otherwise, including U.S. Pat. No. 4,278,344, or various other xerographic or other copiers. Such a copier 10 is preferably adapted to provide in a known manner duplex or simplex collated copy sets from either duplex or simplex original documents circulated by the RDH 20. As is conventionally practiced, the entire document handler unit 20 may pivotally mount to the copier so as to be liftable by the operator up away from the platen for alternative manual document placement and copying.

The exemplary copier 10 and RDH 20 may alternatively be of various other similar or known types, such as are disclosed in above-cited patents. For example, the exemplary RDH 20 structure illustrated here may be like that shown in U.S. Pat. No. 4,794,429 issued Dec. 27, 1988 to T. Acquaviva, or U.S. Pat. No. 4,731,637 issued March 15, 1988 to T. Acquaviva and T. R. Cross. This general type of RDH is also shown in various cited and other patents thereon such as U.S. Pat. No. 4,579,444.

All references cited in this specification, and their references, are incorporated by reference herein where appropriate for appropriate teachings of additional or alternative details, features, and/or technical background.

For illustrative clarity here, the exemplary document and copy sheets in the various different steps or modes are all drawn here with exaggerated spacing between the document and copy sheets being stacked. In actual operation these stacked sheets would be directly superposed.

The RDH 20 provides for automatically feeding or transporting individual registered and spaced document sheets onto and over the imaging station 23, i.e. over the platen of the copier 10. For illustrative clarity here a platen is not illustrated in this schematic figure. The platen transport system 24 may be an incrementally servo motor driven non-slip or vacuum belt system controlled by the copier controller 100 in a manner taught by the above-cited references to stop the document at a desired registration (copying) position.

Figure 1:
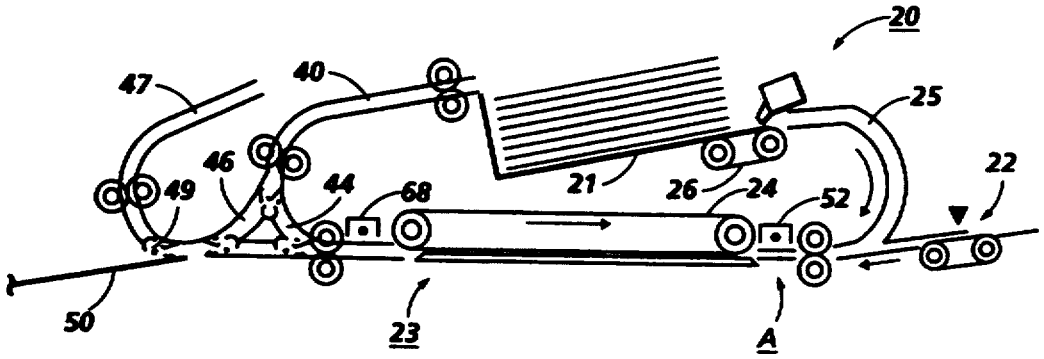
FIG. 1 is an enlarged elevational view of the RDH in which the present invention is employed.

The RDH 20 here (see FIG. 1) has a typical "racetrack" document loop path configuration, and preferably has generally known per se inverting and non-inverting return recirculation paths to the RDH loading and restacking tray 21. An exemplary set of duplex document sheets is shown stacked in this document tray 21. The RDH 20 is a dual input RDH/SADH document handler, having an alternate semiautomatic document handling (SADH) side loading slot 22. Documents may be fed to the same imaging station 23 to be copied by the same platen transport belt 24 from either the SADH input 22 at one side of the RDH unit 20, or from the regular RDH input—the loading or stacking tray 21—on top of the RDH unit. As noted, that second input 22 is referred to herein as the SADH input 22, although it is not limited to semi-automatic document input feeding which will be discussed supra. The regular RDH document feeding input is from the bottom of the stack in tray 21 through an arcuate, inverting, RDH input path 25 to the upstream end of the platen transport 24. This input path 25 preferably includes a known stack bottom corrugating feeder-separator belt and air knife system 26, document position sensors, and a first set of turn baffles and feed rollers to naturally invert the documents once before copying.

Document inverting or non-inverting by the RDH may be as described, for example, in U.S. Pat. No. 4,794,429 or 4,731,637. After the documents are copied on the platen imaging station 23, or fed across the platen without copying, they may be ejected by the platen transport system 24 into downstream or off-platen rollers and fed past a gate or gates and sensors. Depending on the positions of these gates, they either guide the documents straight out directly to a document output path to a catch tray 50, or, more commonly, the documents are instead deflected by a decision gate past a further sensor into an RDH return path 40 taking them back to tray 21 to restack on top of the documents then in tray 21, so that the document set can be continuously refed and recirculated. This RDH return path 40 includes reversible rollers to provide a choice of two different return paths to the RDH tray 21; a simplex return path 44 with one inversion, or a reversible duplex return path 46 without an inversion (called an inverter), as further explained below. For the duplex path 46 the reversible rollers are reversed to reverse feed the previous trail edge of the sheet back into the duplex return path 46 from an inverter chute 47 (curved in this case). This duplex return path 46 provides a desired inversion of duplex documents in one circulation, as they are returned to the tray 21, as compared to their previous orientation in tray 21, for copying their opposite sides in a subsequent circulation, or circulations, as described in the above-cited art. Normally this RDH inverter and inversion path 46, 47 is used only for RDH input tray 21 loaded documents and only for duplex documents. In normal operation a duplex document has only one inversion per circulation (occurring in the RDH input path 25). In contrast, in the simplex circulation path there are two inversions per circulation, one in each of the paths 25 and 44. Two inversions per circulation equals no inversion. Thus, simplex documents are returned to tray 21 in their original (face up) orientation via the simplex path 44, 40.

The entire stack of originals in the RDH tray 21 can be plurally recirculated and copied to produce plural collated copy sets. The document set or stack may be RDH recirculated any number of times to produce any desired number of precollated duplex copy sets. That is, sets of duplex copy sheets.

Referring further to the exemplary copier or duplicator 10 here, since such copier operation and apparatus is known and taught in the cited and other art it need not be re-explained in detail herein. Blank or clean copy sheets can be conventionally fed from paper trays 11 or 12, or the high-capacity tray input thereunder, to receive an image on their first sides from photoreceptor 13 at transfer station 14, to be fused in a fuser 15 and temporarily stacked in a duplex buffer tray 16 for subsequent return (inverted) via path 17 therefrom for receiving a second side image in the same manner as the first side. The completed duplex copy is preferably exited to an integral finishing and stacking module via output path 18. An optionally operated copy path sheet inverter 19 is also provided.

All copier and document handler and finisher operations are preferably controlled by a generally conventional programmable controller 100. The copier 10 and its RDH 20 here are additionally programmed with certain novel functions described herein. The controller 100 preferably comprises a known programmable microprocessor system, as exemplified by the above cited and other extensive prior art, e.g., U.S. Pat. No. 4,475,156 and its references. The controller 100 controls all of the machine steps and functions described herein, including all sheet feeding. This includes the actuations of the document and copy sheet feeders and inverters, gates, etc. As further taught in the references, the controller 100 also conventionally provides for storage and comparison of the counts of the copy and document sheets, the number of documents fed and recirculated in a document set, the desired number of copy sets, and other selections by the operator through a connecting panel of numerical and other control or function selection switches. Controller information and sheet path sensors are utilized to control and keep track of the positions of the respective document and the copy sheets and the operative components of the apparatus by their connection to the controller. The controller may be conventionally connected to receive and act upon jam, timing, positional, and other control signals from various sheet sensors in the document recirculation paths and the copy sheet paths. The controller automatically actuates and regulates the positions of sheet path selection gates depending upon which mode of operation is selected and the status of copying in that mode. The controller 100 also conventionally operates and changes displays on a connecting instructional display panel portion thereof, which preferably includes said operator selection buttons or switches. Here this machine controller 100 preferably includes a known touch-screen type of operator input control and display.

A conventional document set separator in the RDH, connected to the controller 100 conventionally provides a signal indicating that the last sheet of the document set has been fed, i.e., that a single document set circulation has been completed. See, e.g., U.S. Pat. No. 4,589,645.

In the illustrated operation of the copier 10 in FIG. 10 here, for the illustrated copying mode, simplex irregular sheets will be discussed herein, and as shown in the sequence of FIGS. 2–8.

Figure 2:
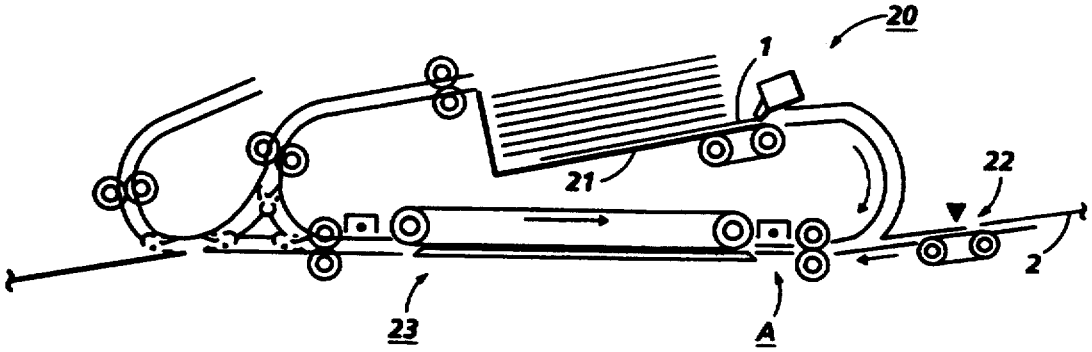
FIGS. 2 illustrates the loading of irregular sheet into a SADH slot and blank sheets into the RDH of FIG. 1.
Figure 3:
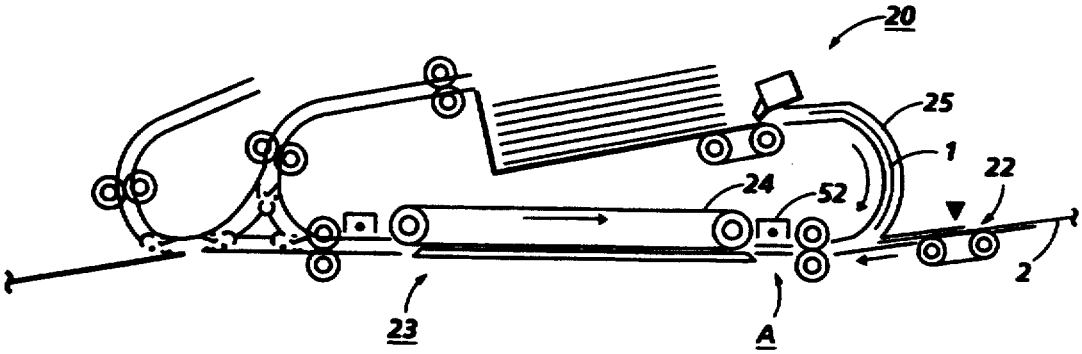
FIGS. 3 illustrates the feeding of an irregular sheet and a blank sheet.
Figure 4:
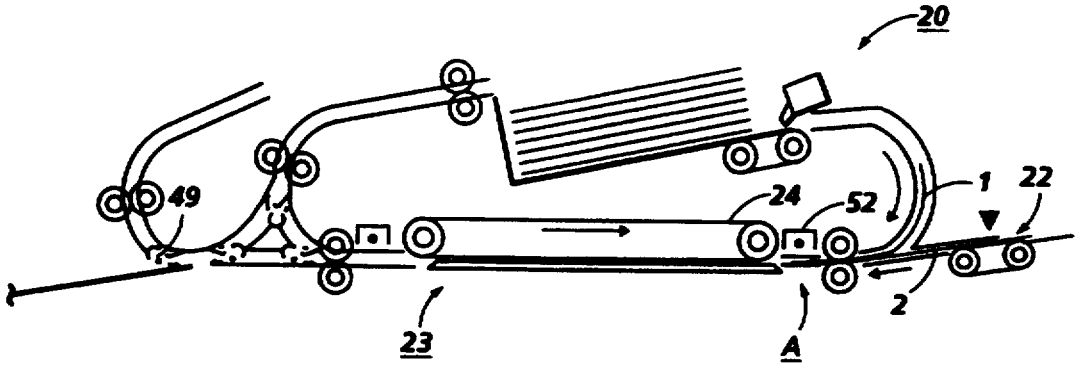
FIGS. 4 illustrates the tacking of the blank sheet to the irregular sheet.
Figure 5:
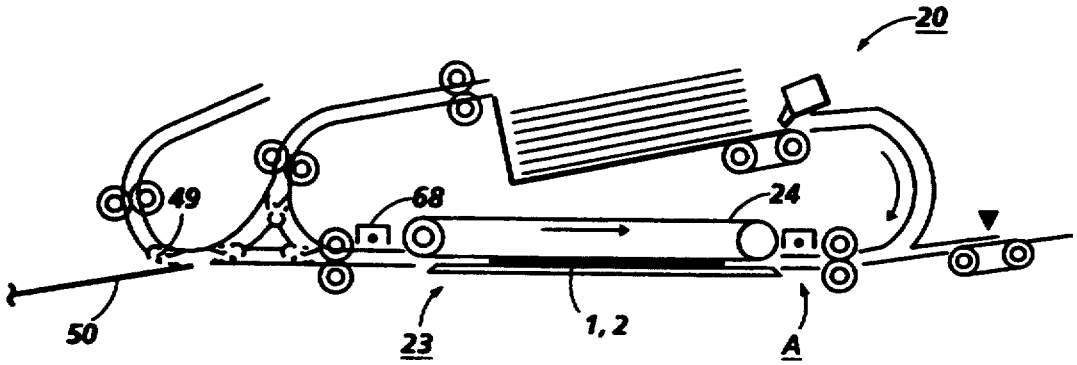
FIGS. 5 illustrates the feeding of the the irregular sheet to the copying position with blank sheet thereon.
Figure 9:
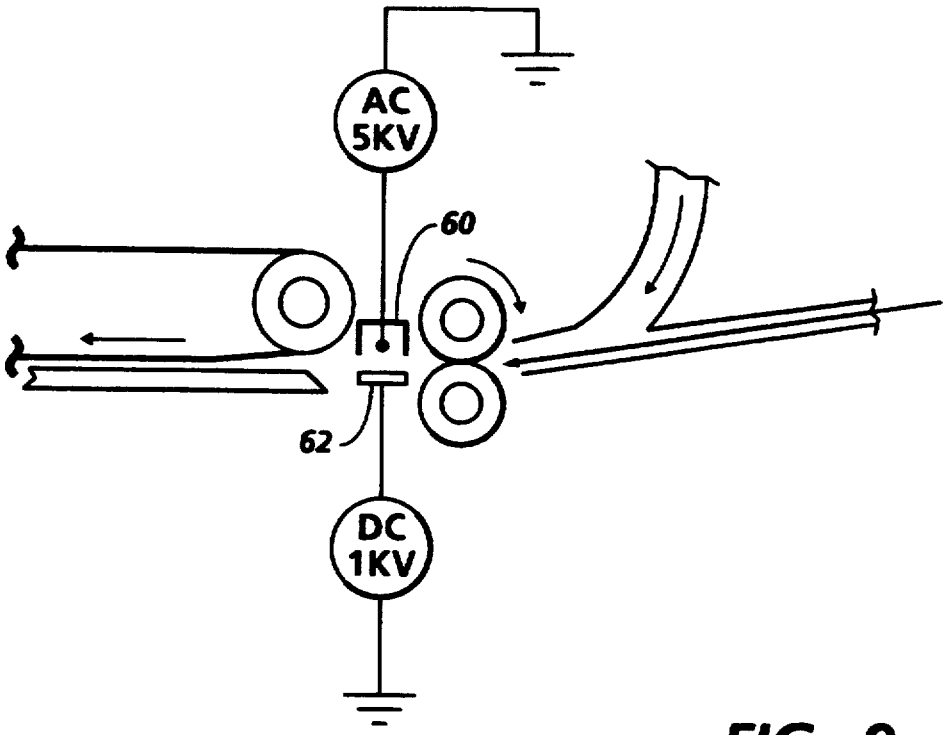
FIG. 9 is an enlarged view of the tacking system employed in the present invention.

In FIGS. 2–6, there is shown by way of one example shown in several steps, copier 10 feeding and copying irregular sheets such as a transparency document. Blank copy sheets (e.g. 8 ½ by 11 or larger for copying 8 ½ by 11 transparencies) equal to or greater than the number of transparencies to be copied are placed in RDH 20 as shown in FIG. 2. Transparency sheets are loaded image side down, one at a time into the SADH slot 22, also shown in FIG. 2. Transparency sheet 1 is fed out to the imaging station 23 and blank sheet 1 is fed from RDH 20 as shown in FIG. 3. Transparency sheet 2 is charged by tacking device 52 at tacking station A, preferably, only the lead edge is charged. Referring to FIG. 9, tacking device 52 includes an AC static eliminator 60 spaced apart from a metal plate 62 which is DC powered, preferably the gap spacing is approximately one inch. The feed timing is controlled by controller 100 such that the lead edge of both transparency sheet 2 and blank sheet 1 arrive at the tacking station A simultaneously as shown in FIG. 4. Transparency sheet 1 is charged so that it will tack to blank sheet 2. Blank sheet/transparency sheet sandwich 1, 2 with the transparency on the bottom is transported to be exposed at the desired registration (copying) position as shown in FIG. 5. In this manner, Blank sheet/transparency sheet sandwich 1, 2 move across the platen and do not become separated. After, blank sheet/transparency sheet sandwich 1, 2 is exposed, platen transport system 24 moves blank sheet/-transparency sheet sandwich 1, 2 off the platen imaging station 23. Detacking device 68 charges blank sheet/-transparency sheet sandwich 1, 2 so that static charge between blank sheet 1 and transparency 2 are eliminated. Blank sheet 1 and transparency 2 are fed under gate 49 which is operated to stack the two sheets to output tray 50. In this manner, transparencies are restacked face down in the same order as they were loaded in SADH slot 22, but are interleaved with blank sheets.

Figure 6:
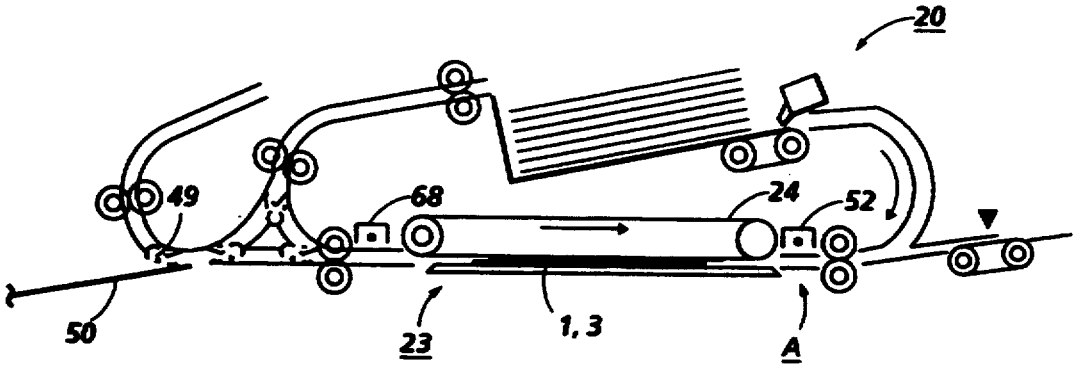

It will be also appreciated that other irregular sheets such as tab sheets can be copied in a similar manner. Tab sheets are sheets having a tab portion (as shown in FIG. 7 as tab sheet 3 having tab portion 5). Blank copy sheets equal to or greater than the number of tab sheets to be copied are placed in RDH 20. Tab sheets are loaded into the SADH slot 22, one at a time, and fed out to the imaging station 23. At the appropriate time, blank sheet 1 is fed from RDH 20. Tab sheet 3 is charged by tacking device 52 at tacking device station A. The feed timing is controlled by controller 100 such that blank sheet 1 overlaps tab portion 5 of tab sheet 3 at tacking station A (as shown in FIG. 6 and 7 ). Tab sheet 3 is charged so that it will tack to blank sheet 1. Blank sheet/tab sheet sandwich 1, 3 with tab sheet 3 on the bottom is transported by platen transport system 24 to the desired registration (copying) position. After blank sheet/tab sheet sandwich 1, 3 is exposed, platen transport system 24 moves blank sheet/tab sheet sandwich 1, 3 off the platen 23. Detacking device 68 charges blank sheet/tab sheet sandwich 1, 3 so that the static charge between the blank sheet and the tab sheet is eliminated. Then, blank sheet 1 and tab sheet 2 are fed under gate 49 which deflects them to stacking tray 50. In this manner, the tab sheets are restacked face down in the same order as they were loaded in SADH tray 22, but are interleaved with blank sheets.

For light jobs (i.e. one or two copies) if desired, an irregular sheet, such as a transparency or tab, may be loaded together with a blank sheet overlying the irregular sheet into SADH slot 22 as shown in FIG. 8. Both sheets are fed out of SADH slot 22 and pass under tacking device 52 at tacking device Station A where the irregular sheet and the blank sheet are tacked together. The tacked sheets are advance to the imaging station 23. In this manner, no special timing is required by the controller 100 and the tacked sheets are registered at the registration (copying) position. After the tacked sheets are exposed, platen transport system 24 moves the tacked sheets off the platen imaging station 23. Detacking device 68 charges the stacked sheets so that static charge between the blank sheet and the irregular sheet are eliminated. The blank sheet and irregular sheet are fed under gate 49 which is operated to stack the two sheets to an output tray 50.

While the embodiment disclosed herein is preferred, it will be appreciated from this teaching that various alternatives, modifications, variations or improvements therein may be made by those skilled in the art, which are intended to be encompassed by the following claims.

I claim:

1. An apparatus for advancing sheets to a copying station of a copier, comprising:

means for feeding an irregular sheet and a blank sheet to the copying station; and a tacking station for tacking the blank sheet to the irregular sheet before the irregular sheet reaches the copying station.

2. The apparatus of claim 1, wherein said feeding means comprises:

a first loading station for loading the irregular sheet therein; and a second loading station for loading the blank sheet therein.

3. The apparatus of claim 2, wherein said tacking station comprises a charging device for spraying ions onto the blank sheet to electrostatically attract the irregular sheet to the blank sheet.

4. The apparatus of claim 3, wherein said charging device comprises a static eliminator and a metal plate, said static eliminator being spaced apart from said metal plate to define a passageway through which the irregular sheet and the blank sheet pass with the blank sheet and the irregular sheet being electrostatically attracted to each other.

5. The apparatus of claim 2, wherein said tacking station tacks a leading edge of the irregular sheet to the blank sheet.

6. The apparatus of claim 2, further comprising a detacking station for detacking the irregular sheet from the blank sheet after the irregular sheet advances from the copying station.

7. The apparatus of claim 2, wherein said feeding means comprises control means for controlling said first and second loading station so that the blank sheet overlies the irregular sheet before said tacking station.

8. A copying method for advancing sheets to a copying station of a copier, comprising the steps of:

feeding an irregular sheet and a blank sheet to the copying station;

tacking the blank sheet to the irregular sheet before the irregular sheet reaches the copying station; and copying the irregular sheet with the blank sheet tacked thereon at the copying station.

9. The copying method of claim 8, further comprising the steps of:

loading the irregular sheet into a first loading station before said feeding step; and loading the blank sheet into a second loading station before said feeding step.

10. The copying method of claim 8, further comprising the steps of:

feeding the irregular sheet with the blank sheet thereon from the copying station; and separating the blank sheet from the irregular sheet.

11. The copying method of claim 9, wherein said feeding step comprises the step of controlling the first and second loading stations so that the blank sheet overlies the irregular sheet before said tacking step.

12. The copying method of claim 8, wherein said tacking step comprises the step of charging the irregular sheet to electrostatically attract the irregular blank sheet to one another.

13. A printing machine of the type in which sheets are advanced to a copying station, comprising:

means for feeding an irregular sheet and a blank sheet to the copying station; and a tacking station for tacking the blank sheet to the irregular sheet before the irregular sheet reaches the copying station.

14. The printing machine of claim 13, wherein said feeding means comprises:

a first loading station for loading the irregular sheet therein; and a second loading station for loading the blank sheet therein.

15. The printing machine of claim 14, wherein said tacking station comprises a charging device for spraying ions onto the blank sheet to electrostatically attract the irregular sheet to the blank sheet.

16. The printing machine of claim 15, wherein said charging device comprises a static eliminator and a metal plate, said static eliminator being spaced apart from said metal plate to define a passageway through which the irregular sheet and the blank sheet pass with the blank sheet and the irregular sheet being electrostatically attracted to each other.

17. The printing machine of claim 14, wherein said tacking station tacks a leading edge of the irregular sheet to the blank sheet.

18. The printing machine of claim 14, further comprising a detacking station for detacking the irregular sheet from the blank sheet after the irregular sheet advances from the copying station.

19. The printing machine of claim 14, wherein said feeding means comprises control means for controlling said first and second loading station so that the blank sheet overlies the irregular sheet before said tacking station.

* * * * *